US005654722A

United States Patent [19]

Lundbäck et al.

[11] Patent Number: 5,654,722

[45] Date of Patent: Aug. 5, 1997

[54] DEVICE AT ANTENNA SYSTEMS FOR GENERATING RADIO WAVES

[75] Inventors: Hans Olof Lundbäck, Markaryd; Stefan Georg Eriksson, Timmernabben, both of Sweden

[73] Assignees: Teracom Components AB, Horby; Antel Sweden AB, Alem, both of Sweden

[21] Appl. No.: 570,665

[22] Filed: Dec. 11, 1995

[30] Foreign Application Priority Data

Dec. 12, 1994 [SE] Sweden ..... 9404312-2

[51] Int. Cl.[6] ..... H01Q 21/29

[52] U.S. Cl. ..... 343/725; 343/727; 343/890

[58] Field of Search ..... 343/725, 727, 343/841, 890, 891, 789, 799, 800, 782, 815; H01Q 21/29

[56] References Cited

U.S. PATENT DOCUMENTS

| | | | |
|---|---|---|---|
| 3,710,340 | 1/1973 | Mayes | 343/725 |
| 4,329,690 | 5/1982 | Parker | 343/725 |

FOREIGN PATENT DOCUMENTS

| | | | |
|---|---|---|---|
| 1078643 | 3/1960 | Germany | 343/800 |
| WO90/1059 | 3/1990 | WIPO . | |

*Primary Examiner*—Michael C. Wimer
*Attorney, Agent, or Firm*—McCormick, Paulding & Huber

[57] ABSTRACT

The invention relates to a device at antenna systems for generating radio waves, including a supporting structure mounting at least one main radiator (3) for transmitting radio waves and where high frequency electric currents are generated in the supporting structure when the main radiator (3) is transmitting the radio waves. In order to improve the range of the main radiator (3) and at the same time reduce its backward radiation, the supporting structure includes a secondary radiator (14) for each main radiator (3). The secondary radiator (14) has at least one break portion (12) for interrupting or breaking the high frequency currents generated therein and through the thereby interrupted flow of the high frequency currents in the supporting structure reduce deviations from the desired range and/or direction of the radio waves transmitted by the main radiator (3). The secondary radiator (14) includes a connecting means (13) provided to connect portions of the supporting structure located on opposite sides of the break portion (12), whereby the connecting means (13) is provided to impart a flow path to the high frequency currents flowing through the supporting structure such that the energy represented by the currents permits the secondary radiator (14) to transmit radio waves with a suitable amplitude and phase relative to the amplitude and phase of the radio waves transmitted by the main radiator (3).

8 Claims, 6 Drawing Sheets

HORIZONTAL AMPLITUDE:

Antenna type: . . . . . Frequency: 600.000MHz

Comment: . . . . . .

Number of elements: 4 Max-Gain: 0.0dB Abs-Phase: 0.0 degrees

File name: <untitled> . . . . . .

| Element | Element-type | Bearing | Center dist. (mm) | Lat.off-set(mm)* | Phase | Effect |
|---|---|---|---|---|---|---|
| 1 | BRW4701-600(slot) | 0.0 | 320 | 30 | 0.0 | 1.00 |
| 2 | BRW4701-600(slot) | 90.0 | 320 | 30 | -90.0 | 1.00 |
| 3 | BRW4701-600(slot) | 180.0 | 320 | 30 | -180.0 | 1.00 |
| 4 | BRW4701-600(slot) | 270.0 | 320 | 30 | -270.0 | 1.00 |

* Lateral offset positive clockwise

Antenna type: . . . . . Frequency: 600.000MHz

Comment: . . . . . .

Number of elements: 4 Max-Gain: 0.0dB Abs-Phase: 0.0 degrees

File name: <untitled> . . . . . .

| Element | Element-type | Bearing | Center dist. (mm) | Lat.off-set(mm)* | Phase | Effect |
|---|---|---|---|---|---|---|
| 1 | BRW4701-600MHz | 0.0 | 320 | 115 | 0.0 | 1.00 |
| 2 | BRW4701-600MHz | 90.0 | 320 | 115 | -90.0 | 1.00 |
| 3 | BRW4701-600MHz | 180.0 | 320 | 115 | -180.0 | 1.00 |
| 4 | BRW4701-600MHz | 270.0 | 320 | 115 | -270.0 | 1.00 |

* Lateral offset positive clockwise

DEVICE AT ANTENNA SYSTEMS FOR GENERATING RADIO WAVES

BACKGROUND OF THE INVENTION

The present invention relates to a device at antenna systems for generating radio waves, whereby the antenna system includes a supporting structure on which there is provided at least one main radiator for transmitting radio waves and whereby high-frequency electric currents are generated in the supporting member when the main radiator is activated to transmit radio waves.

At the antenna system described above, undesired high-frequency currents occur in the supporting structure with the result, inter alia, that the radiation pattern representing the radiation of radio waves of one or more main radiators gets an undesired irregular shape and thus, the radiation gets an undesired range.

Furthermore, said undesired high-frequency currents in the supporting structure result in that the radiation from the main radiator partially starts out in the wrong direction, e.g. backwards. This means that a powerful electromagnetic field is generated behind the supporting structure, i.e. normally in those parts of the mast supporting the antenna system wherein personell resides for service or repair.

SUMMARY OF THE INVENTION

The object of the present invention has been to eliminate these problems and provide by simple means an improved antenna system of the abovementioned type. This is arrived at according to the invention by providing the initially defined device with the characterizing features of subsequent claim 1.

By the provision of the secondary transmitter defined in said characterizing features, it is achieved that the radiation pattern representing the radiation of radio waves from the main radiator or main radiators is improved while simultaneously the electromagnetic field behind the main radiators, i.e. normally within the mast, is reduced so that personell can reside inside the mast when the antenna system is operating without the risk of being subjected to unacceptably high radiation. According to said characterizing features this is arrived at by simple means and at low cost.

BRIEF DESCRIPTION OF THE DRAWINGS

The invention will be further described below with reference to the accompanying drawings, wherein FIG. 1 with a perspective view illustrates a device according to the invention on a mast with four main radiators.

DESCRIPTION OF THE ILLUSTRATED EMBODIMENT

Figure 1:
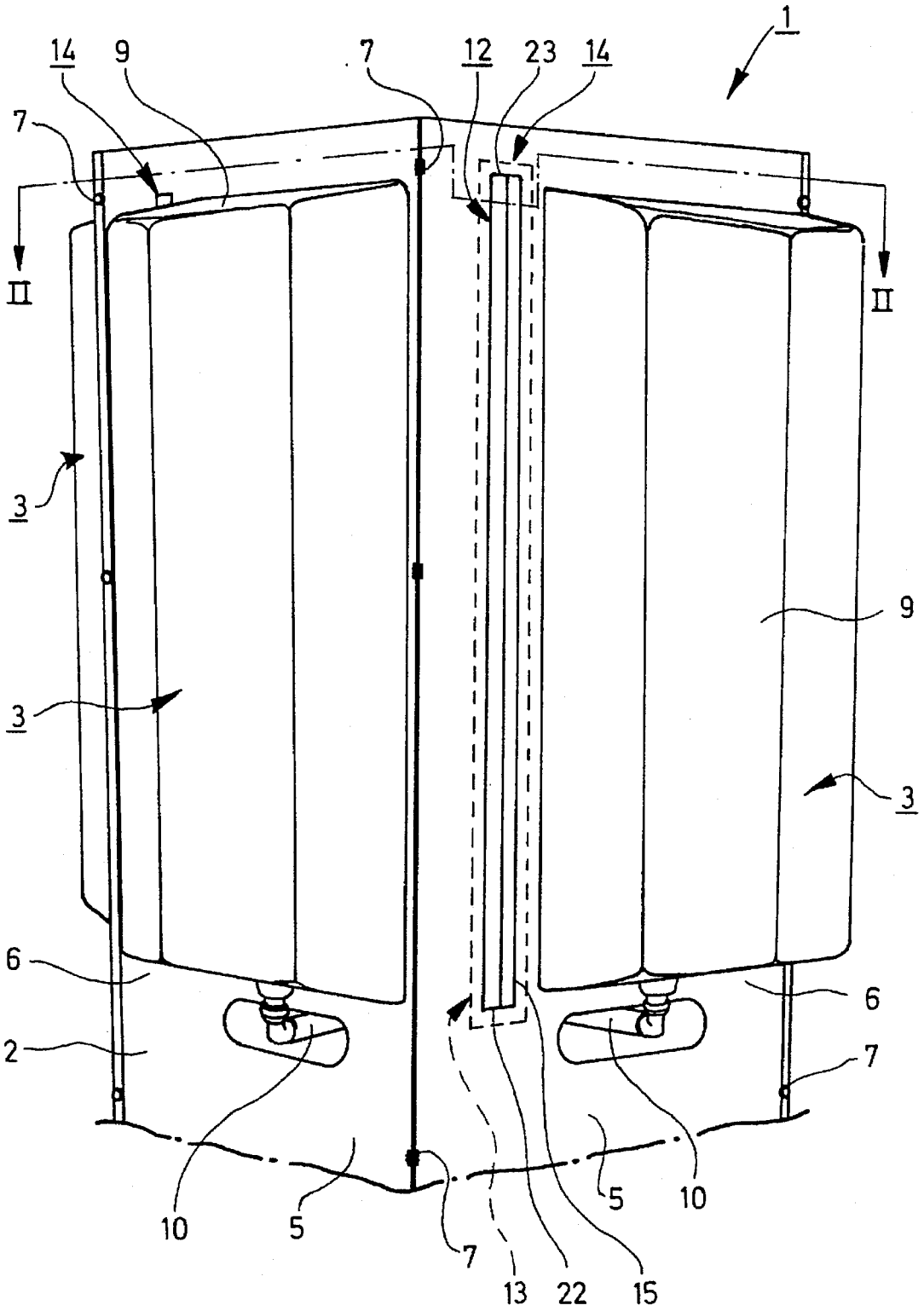

In the drawings there is illustrated an antenna system 1 for generating radio waves. This antenna system 1 includes a supporting structure 2 in the form of a mast with four main radiators 3 for transmitting radio waves. The supporting structure 2 has four sides 5 consisting of metal plates 6 of preferably stainless material. The four metal plates 6 are attached to each other by means of bolt connections 7 and together they define a four sided inner space 8 through which personell can pass for carrying out work on the antenna system.

On each metal plate 6 there is mounted a main radiator 3 so that all four main radiators 3 transmit radio waves in different directions. Since the main radiators 3, their housings 9, their connection cables 10 and their mounting means 11 are commonly known and mounted in a conventional manner, they are not further described herein.

When the main radiators 3 are activated to transmit radio waves, high-frequency electric currents are generated in each metal plate 6. In order to interrupt or break these high-frequency electric currents so that they do not flow through the metal plate 6 in its entire width, every metal plate 6 has a break portion 12 whereby a secondary radiator 14 is formed, which reduces deviations from the desired range and/or direction of the radio waves transmitted by the main radiator 3.

This secondary radiator 14 is defined also by a connecting means 13 which is located on an inner side of the metal plate 6 and connect portions **6*a*, 6*b* of the metal plate 6 situated on opposite sides of the break portion 12 with each other. The connecting means 13 is provided to impart another flow path to the high-frequency electric currents flowing through the metal plate 6 than the one said electric currents should have if the metal plate had no break portion 12 and connecting means 13, namely such a flow path that the energy represented by the electric currents permits the secondary radiator 14 formed at the break portion 12 to radiate or transmit radio waves with a suitable amplitude and phase relative to the amplitude and phase of the radio waves transmitted by the main radiator 3. The break portion 12 and/or the connecting means 13 are also arranged to allow positive influence on the range and/or direction of the radio waves transmitted by the main radiator 3**.

Figure 2:
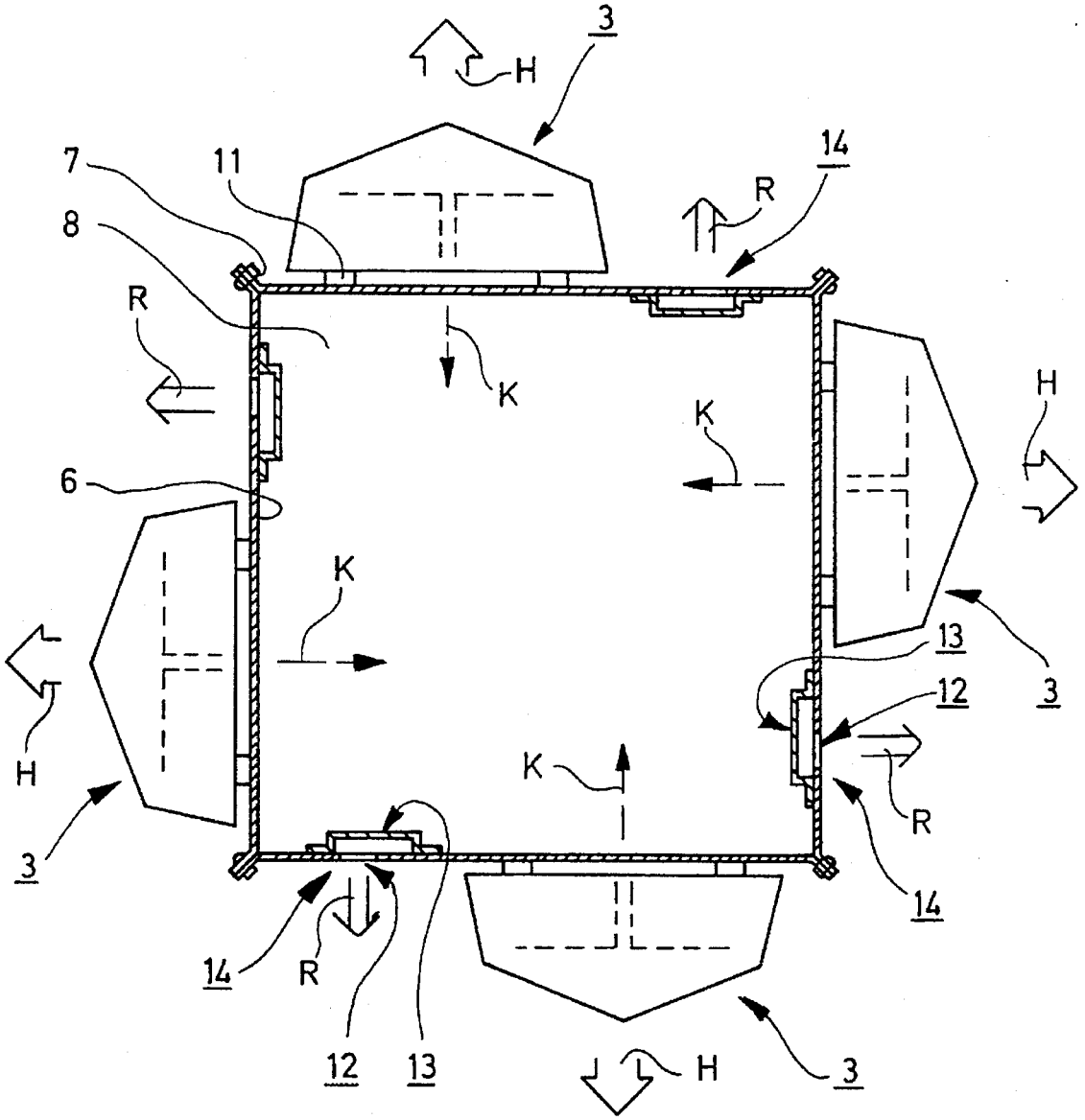
FIG. 2 is a section along the line II—II through the mast in FIG. 1.
Figure 4:
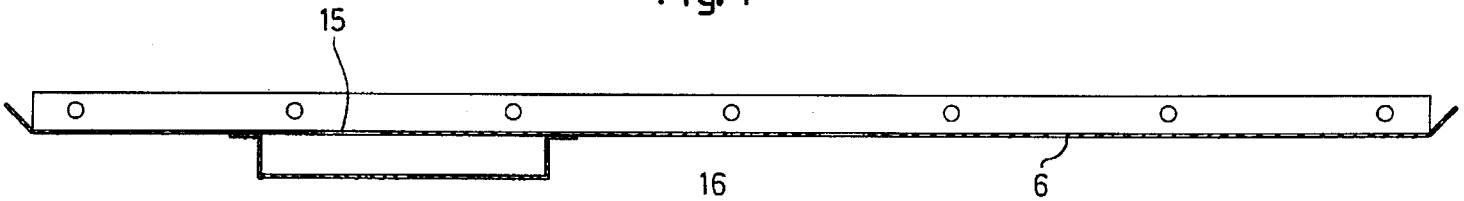
FIG. 4 is a section along the line IV—IV through the metal plate in FIG. 3.
Figure 3:
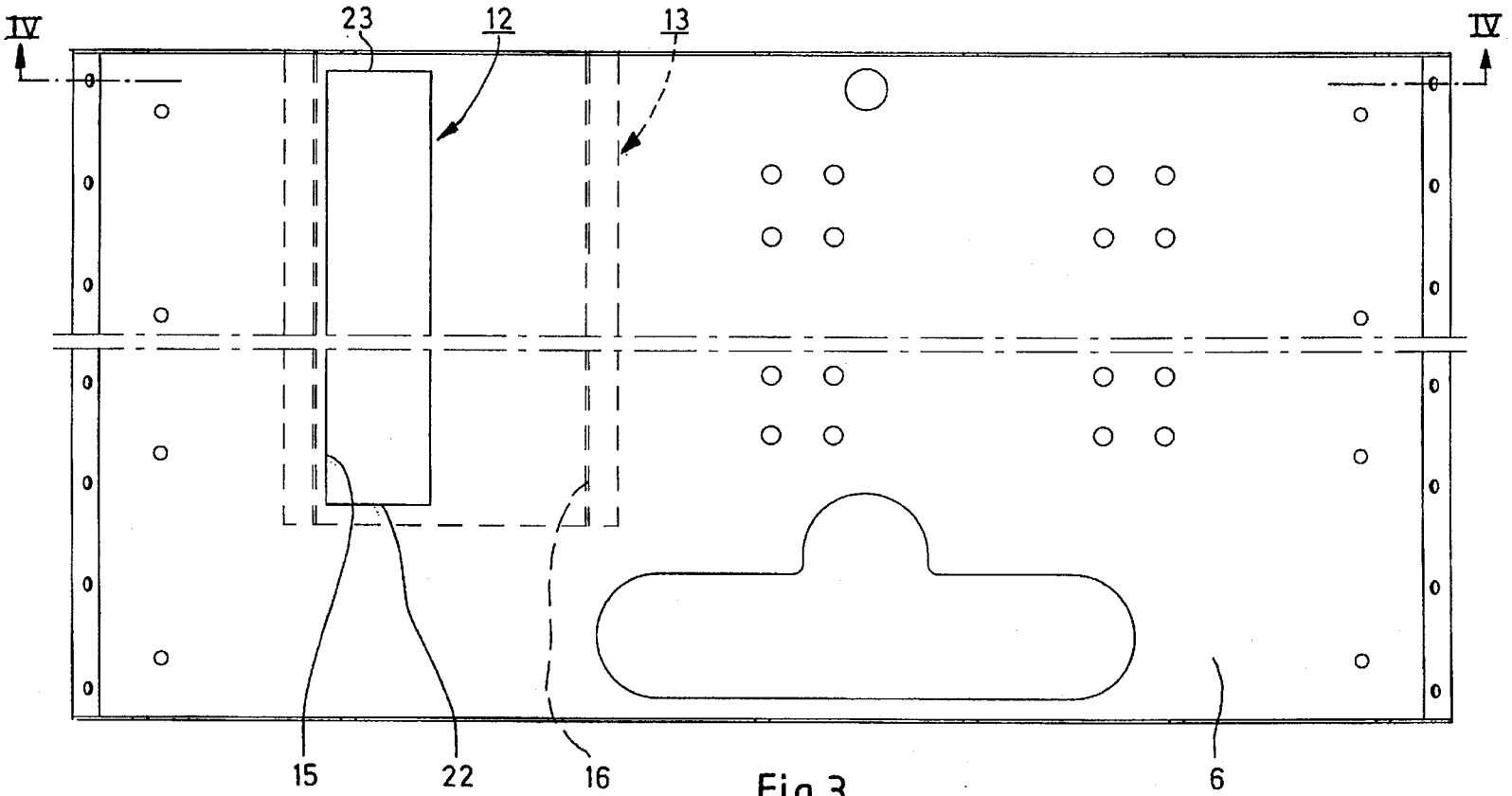
FIG. 3 is a plan view of a metal plate forming part of the mast of FIG. 1 and 2 and having a device according to the invention.

The break portion 12 and/or connecting means 13 is/are preferably provided to reduce or eliminate radio wave radiation directed backwards (arrow K in FIG. 2) relative to the desired direction of radiation of the main radiator 3 (arrow H in FIG. 2), since such a backwards directed radio wave radiation will be present in the inner space 8 of the supporting structure 2 and thereby subject the personell passing therethrough to radiation.

Furthermore, the break portion 12 and/or connecting means 13 is/are preferably mounted to have a positive effect on the desired range and/or direction of radio waves in a transient area between radio waves transmitted by several different main radiators.

Figure 5:
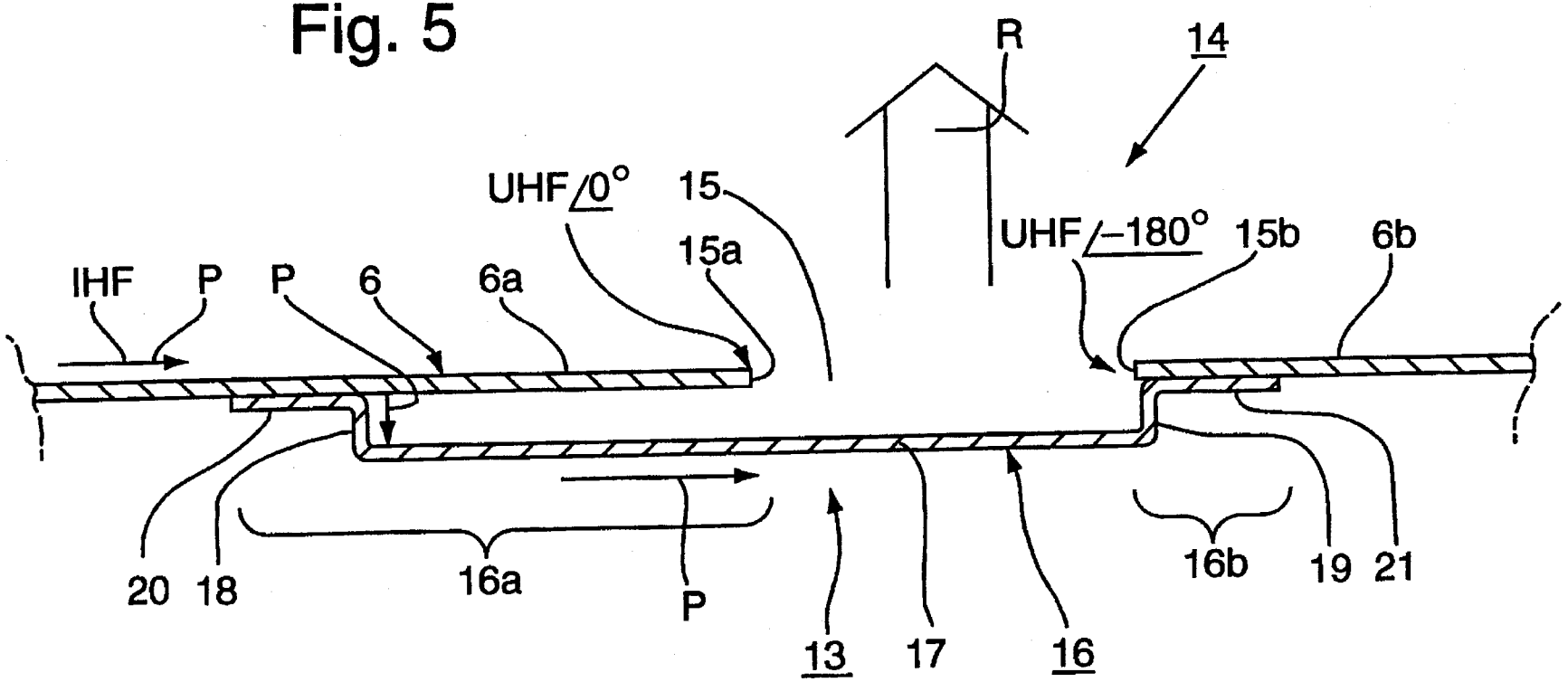
FIG. 5 is a schematic view representing the phase position of high-frequency currents at a device according to the invention.

As is apparent from FIG. 5, the break portion 12 is preferably a slot 15 and the connecting means 13 preferably an elongated strip plate 16 of stainless or another suitable material and with a U-shaped or substantially U-shaped profile. The strip plate 16 consists of a web portion 17 with shanks 18 and 19 which may have outwardly directed flange portions 20 and 21 through which the strip plate 16 engages the inner side of the metal plate 6 on both sides of the slot 15, i.e. on the portions **6*a*, 6*b* of said metal plate 6. The flange portions 20, 21 can be attached to the strip plate 16** by spot welding or by any other suitable method.

FIG. 5 also illustrates the direction and path (arrows $I_{HF}$) of the high-frequency currents in the metal plate 6 and strip plate 16 when the main radiator 3 is activated, as well as the phase positions of said high-frequency currents. Thus, the voltage of the high-frequency currents is designated $U_{HF}$ and the phase position/0°, i.e. 0° at the first edge 15*a* of the slot 15 seen in the flow direction $I_{HF}$ of the high-frequency currents, and/−180°, i.e. −180° at the opposite edge 15*b* of said slot 15. The high-frequency energy emitted from the slot 15 and the elongated strip plate 16 is shown with an arrow R in FIG. 5.

Figure 6:
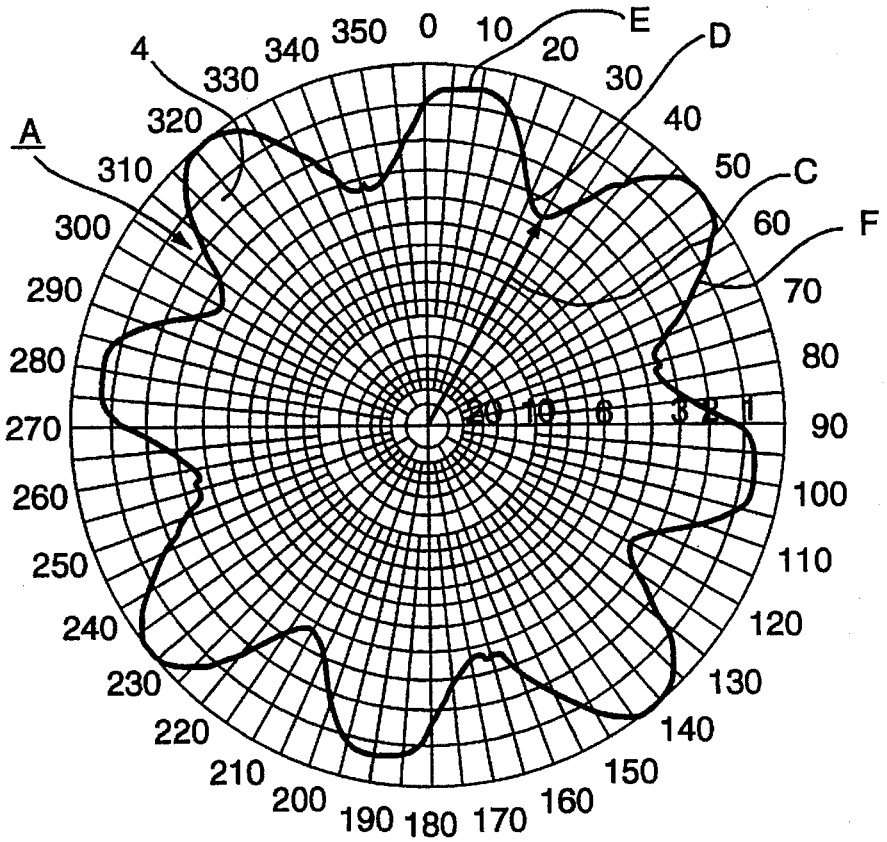
FIG. 6 is a schematic view of a radiation diagram representing the radiation from four main radiators and obtained with a device according to the invention.
Figure 7:
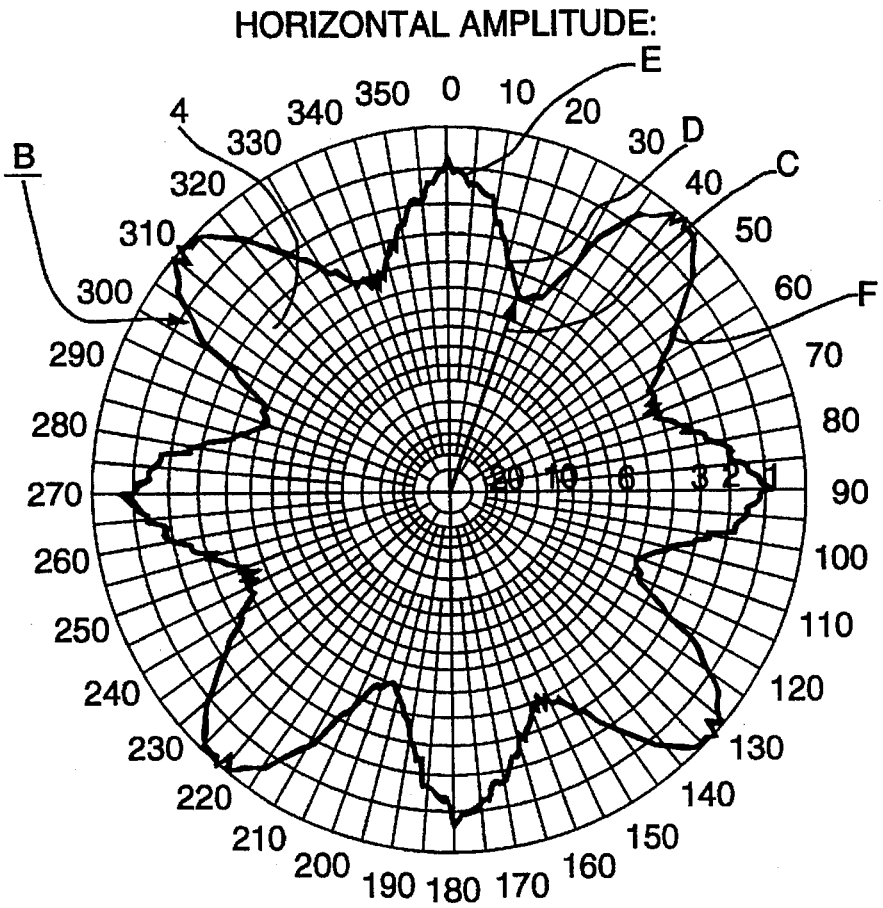
FIG. 7 is a schematic view of a radiation diagram representing the radiation from four main radiators but without a device according to the invention.

From FIGS. 6 and 7 radiation diagrams A and B appear, of which the radiation diagram A in FIG. 6 illustrates the radio wave radiation at an antenna system equipped with a secondary radiator 14 and provided with four main radiators (in the diagram designated Element 1, 2, 3 and 4). FIG. 7 however, illustrates the radio wave radiation at an antenna system of corresponding type but without secondary radiator 14. A comparison between the radiation diagrams A and B shows that the range of the radio wave radiation is substantially better in radiation diagram A than in radiation diagram B. A comparison between said radiation diagrams A and B also indicates, inter alia, that the range C of radio waves in the transient area D between the radio wave curves E and F which represent two main radiators 3 located beside each other on the supporting structure 2, is substantially better in the radiation diagram A than the corresponding range C of corresponding radio waves in radiation diagram B. In fact, the effect on the radio waves in the transient area D is in radiation diagram A about 20% better than the corresponding effect on the radio waves in radiation diagram B.

Regarding other suitable embodiments of the members illustrated in the drawings, it can be mentioned that every main radiator 3 is elongated and provided on the metal plate 6 so that it extends therealong in vertical direction. The slot 15 is provided in the metal plate 6 beside the main radiator 3 and the length thereof is equal to or somewhat exceeding the length of said main radiator 3, whereby the slot 15 extends somewhat beyond the upper and lower portions of the main radiator 3.

The elongated strip plate 16 is substantially as long as the slot 15 or preferably somewhat longer, whereby it suitably extends somewhat beyond opposing end edges 22, 23 of said slot 15. The strip plate 16 is preferably substantially wider than the slot 15. Furthermore, the strip plate 16 is preferably provided laterally offset relative to the slot 15, whereby the width of the portions 16*a* of said strip plate 16 located within the portion 6*a* of the metal plate 6 on the same side of the slot 15 as the main radiator 3, is greater than the width of the portions 16*b* of said strip plate 16 situated within the portion 6*b* of said metal plate 6 on the other side of the slot 15.

The invention is not limited to what is described above and illustrated in the drawings, but may vary within the scope of the following claims. As examples of not illustrated alternatives it can be mentioned that the break portion 12 can be designed in other ways than as a slot 15 and the connecting means 13 can be designed in other ways than as a separate strip plate 16 which is mounted on the inner side of the metal plate 6. Thus, the metal plate 6 can e.g. be bent inwards to a connecting means 13 integrated therewith. Additionally, the metal plates 6 of the supporting structure may have another form than the substantially rectangular shape as in FIG. 1. The break portion 12 and/or the connecting means 13 may also be designed and/or located to improve other properties of the radio wave radiation from the main radiator 3 than the range and/or direction of its radio wave radiation, such as the effect. Finally, it should be noticed that the antenna system 1 may comprise another number of main radiators, namely one, two, three or another suitable number of main radiators.

We claim:

1. A device at an antenna system for generating radio waves, whereby the antenna system (1) includes a supporting structure (2) on which there is provided at least one elongated main radiator (3) for transmitting radio waves, said main radiator being mounted on the supporting structure so that it extends therealong in a vertical direction, and whereby high-frequency electric currents are generated in the supporting member when the main radiator (3) is activated to transmit radio waves, characterized in that the supporting structure (2) includes a secondary radiator (14) for each main radiator (3), which secondary radiator (14) has at least one elongated break portion (12) situated beside the main radiator (3) for interrupting or breaking the high-frequency electric currents generated therein and through the thereby interrupted flow of the high-frequency electric currents in the supporting structure (2) reduce deviations from the desired range and/or direction of the radio waves transmitted by the main radiator, the length of said break portion being equal to or somewhat exceeding the length of the main radiator and extending to or somewhat beyond lower and upper portions of the main radiator (3);

that the secondary radiator (14) includes a connecting means (13) which is provided to connect portions (6*a*, 6*b*) of the supporting structure (2) located on opposite sides of the break portion (12) with each other on an inner side relative to said break portion (12);

whereby the connecting means (13) is provided to impart a flow path to the high-frequency electric currents flowing through the supporting structure (2) such that the energy represented by said currents permits the secondary radiator (14) to transmit radio waves with a suitable amplitude and phase relative to the amplitude and phase of the radio waves transmitted by the main radiator (3); and whereby the secondary radiator (14) comprising the break portion (12) and connecting means (13) is provided to have a positive influence on the range and/or direction of the radio waves transmitted by the main radiator (3).

2. Device according to claim 1, characterized in that the connecting means (13) is substantially as long as the break portion (12) and preferably somewhat longer than that and extends preferably somewhat beyond opposite end edges (22, 23) of said break portion (12).

3. Device according to claim 1, characterized in that the connecting means (13) is substantially wider than the break portion (12).

4. Device according to claim 3, characterized in that the connecting means (13) is provided laterally offset relative to the break portion (12), whereby the width of those portions (16*a*) of the connecting means (13) that are located within a portion (6*a*) of a metal plate (6) in the supporting structure (2), equipped with the main radiator (3), is greater on one side of the break portion (12) than the width of those portions (16*b*) of the connecting means (13) which are situated within a portion (6*b*) of the metal plate (6) on the opposite side of the break portion (12).

5. Device according to claim 1, characterized in that the break portion (12) consists of a slot (15) provided in a metal plate (6) of a stainless metallic material and forming part of the supporting structure (2).

6. Device according to claim 1, characterized in that the connecting means (13) consists of an elongated strip plate (16) with a substantially U-shaped profile, and that the strip plate (16) engages the inner side of a metal plate (6) forming part of the supporting structure (2), on opposite sides of a break portion (12) formed as a slot (15) therein.

7. Device according to claim 6, characterized in that the elongated strip plate (16) has a web portion (17) which is at least twice as wide as the slot (15) and that said web portion (17) has shanks (18, 19) which preferably include outwardly directed flange portions (20, 21) through which the strip plate (16) engages the upper side of the metal plate (6).

8. Device according to claim 1, whereby the supporting structure (2) has four sides, whereby there is provided a main radiator (3) on each such side, characterized in that with each main radiator (3) in each side of the supporting structure (2) there is associated a secondary radiator (14) defined by a break portion (12) and a connecting means (13).

* * * * *